US008337324B2

(12) United States Patent
Sander et al.

(10) Patent No.: US 8,337,324 B2
(45) Date of Patent: Dec. 25, 2012

(54) GOLF CLUBS AND GOLF CLUB HEADS WITH HIGH CONTACT AREA GROOVE CONFIGURATIONS

(75) Inventors: Raymond J. Sander, Benbrook, TX (US); Robert Boyd, Euless, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/782,240

(22) Filed: May 18, 2010

(65) Prior Publication Data

US 2011/0287856 A1 Nov. 24, 2011

(51) Int. Cl.
*A63B 53/04* (2006.01)

(52) U.S. Cl. ..... 473/330; 473/331

(58) Field of Classification Search ..... 473/330, 473/331; D21/750, 751, 759
See application file for complete search history.

(56) References Cited

U.S. PATENT DOCUMENTS

| | | | | | |
|---|---|---|---|---|---|
| 873,423 | A | * | 12/1907 | Govan | 473/330 |
| 1,089,881 | A | * | 3/1914 | Taylor | 473/328 |
| 1,094,599 | A | * | 4/1914 | Samson | 473/329 |
| 1,524,731 | A | * | 2/1925 | Davis | 473/330 |
| 1,535,670 | A | * | 4/1925 | Kidd | 473/331 |
| 1,965,954 | A | * | 7/1934 | Davis | 473/242 |
| 2,034,936 | A | * | 3/1936 | Barnhart | 473/329 |
| D101,108 | S | * | 9/1936 | Ellingham | D21/751 |
| D122,795 | S | * | 10/1940 | Geerlings | D21/750 |
| D148,193 | S | * | 12/1947 | Smith | D21/750 |
| 3,819,180 | A | * | 6/1974 | Murphy | 473/313 |
| 4,902,016 | A | * | 2/1990 | Boone | 473/330 |
| 4,957,294 | A | | 9/1990 | Long | |
| 4,964,641 | A | * | 10/1990 | Miesch et al. | 473/330 |
| 5,437,088 | A | * | 8/1995 | Igarashi | 29/527.6 |
| 5,584,482 | A | * | 12/1996 | Huang | 473/301 |
| 5,591,092 | A | | 1/1997 | Gilbert | |
| 5,688,186 | A | | 11/1997 | Michaels et al. | |
| 5,688,190 | A | * | 11/1997 | Rowland et al. | 473/330 |
| 5,766,087 | A | | 6/1998 | Kawamatsu | |
| 5,785,610 | A | * | 7/1998 | Birmingham | 473/331 |
| D398,357 | S | * | 9/1998 | De La Cruz et al. | D21/750 |
| 6,007,434 | A | * | 12/1999 | Baker et al. | 473/330 |
| D420,079 | S | * | 2/2000 | Frazetta | D21/747 |
| 6,048,277 | A | * | 4/2000 | Raymond | 473/331 |
| 6,089,993 | A | * | 7/2000 | Woodward et al. | 473/331 |

(Continued)

FOREIGN PATENT DOCUMENTS

JP 8000777 1/1996

OTHER PUBLICATIONS

International Search Report corresponding to PCT Application No. PCT/US2011/032604: dated Aug. 4, 2011.

*Primary Examiner* — Sebastiano Passaniti
(74) *Attorney, Agent, or Firm* — Banner & Witcoff, Ltd.

(57) ABSTRACT

Golf club heads for iron-type golf clubs (including 1 through 9 irons, iron-type hybrid clubs, driving irons, and wedges (e.g., pitching wedges, lob wedges, gap wedges, sand wedges, etc.)) include a striking face. The striking face may comprise a plurality of spaced, parallel grooves that extend across at least a portion of the striking face. The grooves may form a herringbone groove pattern. The herringbone groove pattern may include two or more rows of diagonal, parallel grooves slanting in alternate directions to form a series of parallel Vs. The grooves may be rounded. Other possible groove shapes also are described.

24 Claims, 5 Drawing Sheets

U.S. PATENT DOCUMENTS

| | | | | |
|---|---|---|---|---|
| 6,110,057 | A * | 8/2000 | McKinnon | 473/313 |
| D444,835 | S * | 7/2001 | Wahl et al. | D21/759 |
| 6,277,033 | B1 * | 8/2001 | Krumme et al. | 473/342 |
| 6,354,962 | B1 * | 3/2002 | Galloway et al. | 473/342 |
| 6,814,673 | B2 | 11/2004 | Wahl et al. | |
| 7,056,226 | B2 | 6/2006 | Kennedy | |
| D532,858 | S * | 11/2006 | Rice | D21/759 |
| D544,562 | S * | 6/2007 | Park et al. | D21/759 |
| 7,258,627 | B2 | 8/2007 | Chappell | |
| 7,585,232 | B2 * | 9/2009 | Krumme | 473/329 |
| 7,594,862 | B2 * | 9/2009 | Gilbert | 473/330 |
| D607,070 | S * | 12/2009 | Wada et al. | D21/759 |
| D639,367 | S * | 6/2011 | Reinberg | D21/759 |
| 2008/0051212 | A1 * | 2/2008 | Voges | 473/331 |
| 2009/0093320 | A1 * | 4/2009 | Yoo | 473/330 |
| 2009/0176597 | A1 * | 7/2009 | Yamagishi et al. | 473/331 |
| 2009/0264217 | A1 | 10/2009 | Johnson et al. | |
| 2009/0325728 | A1 | 12/2009 | Solheim et al. | |

* cited by examiner

GOLF CLUBS AND GOLF CLUB HEADS WITH HIGH CONTACT AREA GROOVE CONFIGURATIONS

FIELD OF THE INVENTION

The invention relates generally to golf clubs. More particularly, the invention is directed to iron type golf clubs and golf club heads having various different groove configurations.

BACKGROUND

Typically, a golf club head can include a striking face with a plurality of parallel grooves extending between a toe end and a heel end of the striking face. In particular, the plurality of grooves in a club head can channel out water, sand, grass, and/or other debris that may come between a golf ball and the striking face in order to improve the grip between the golf ball and the striking face and thereby impart spin to the golf ball. The grooves can have various cross-sectional shapes such as a square or rectangular shape, a V-shape, or a U-shape, etc.

Generally, the groove design correlates to the groove contact with a compressed golf ball on the striking face during impact. Additionally, increasing the groove contact area with the compressed ball on the striking face during impact provides more stability and better induces spin to the golf ball when it is launched.

SUMMARY

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to golf club heads for iron-type golf clubs (including 1 through 9 irons, iron-type hybrid clubs, driving irons, and wedges (e.g., pitching wedges, lob wedges, gap wedges, sand wedges, etc.)). Aspects of this invention may also relate to golf club heads for wood-type golf clubs. The striking faces of golf club heads according to this invention may comprise a plurality of spaced, parallel grooves that extend across at least a portion of the striking face. The grooves may form a herringbone groove pattern. This herringbone groove pattern may include two or more rows of diagonal, parallel grooves slanting in alternate directions to form a series of parallel Vs.

Additional aspects of the present invention may include a golf club ball striking face with a herringbone groove pattern that includes a height that is defined from a bottom of a V to a top of that V, and this height may be between approximately 0.1 inches and approximately 0.4 inches. Additionally, the herringbone groove pattern may include a distance defined between each groove that may be between approximately 0.1 inches and approximately 0.5 inches. The herringbone groove pattern may also include a first angle located at a bottom of a V and a second angle located at the top and between adjacent Vs (i.e., connecting adjacent Vs), wherein each of the first angle and the second angle (which may be the same or different) is approximately 10-170 degrees.

Additionally, the golf club head may include a club face with a herringbone groove pattern that is a rounded herringbone groove pattern, wherein the diagonal grooves are rounded.

Additional aspects of this invention relate to golf club structures that include golf club heads, e.g., of the types described above. Such golf club structures further may include one or more of: a shaft attached to the club head (via a hosel), and a grip attached to the shaft.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or the orientation at the address position. Nothing in this specification should be construed as requiring a specific three dimensional orientation of structures in order to fall within the scope of this invention.

A. General Description of Various Features of Iron-Type Golf Clubs According to Examples of this Invention Aspects of this invention relate to golf club heads for iron-type golf clubs (including 1 through 9 irons, iron-type hybrid clubs, driving irons, and wedges (e.g., pitching wedges, lob wedges, gap wedges, sand wedges, etc.)) that include a striking face. Aspects of this invention may also relate to golf club heads for wood-type golf clubs that include a striking face without departing from this invention.

Figure 1:
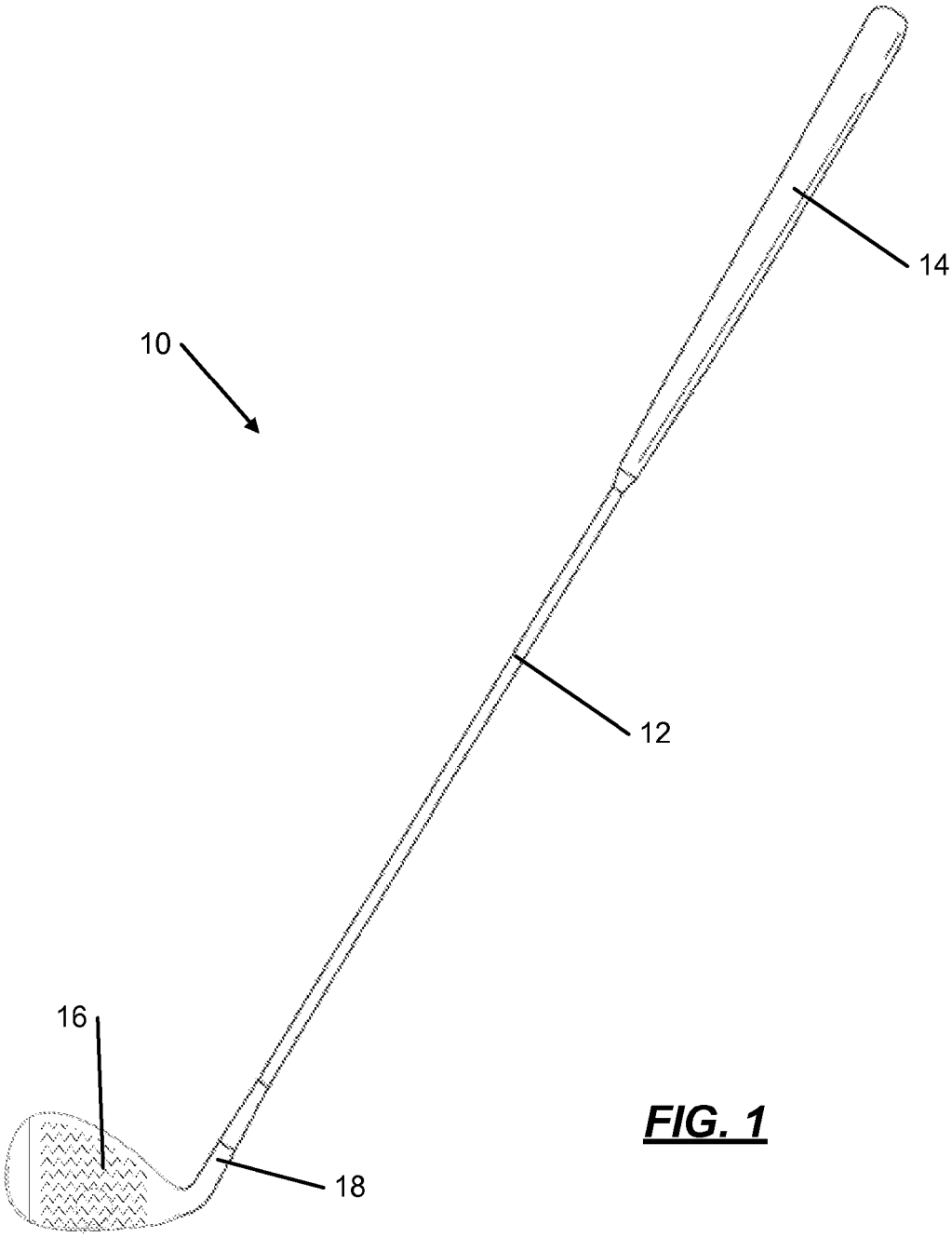
FIG. 1 illustrates an elevation view of an example golf club having a golf club head in accordance with the present invention.

FIG. 1 illustrates an example of an iron-type golf club 10 in accordance with the present disclosure. The golf club 10 includes a shaft 12, a grip 14, and a golf club head 16. The club head 16 of FIG. 1 may be representative of a five iron golf club head of the present invention. The shaft 12 of the golf club 10 may be made of various materials such as steel, titanium, graphite, polymers, or composite materials, including conventional materials as are known and used in the art. The grip 14 is positioned on the shaft 12 to provide a golfer with a slip resistant surface in which to grasp the golf club 10. The grip 14 may be attached to, engaged with, and/or extend from the shaft 12 in any suitable or desired manner, including conventional manners known and used in the art, e.g., using adhesives or cements; via welding soldering, brazing, or the like; via mechanical connectors (such as threads, retaining elements, etc., including through releasable connection structure. A hosel 18 may be connected or part of the golf club head 16 for connecting the shaft 12 of FIG. 1 to the golf club head 16.

The shaft 12 may be received in, engaged with, and/or attached to the club head body 16 in any suitable or desired manner, including conventional manners known and used in the art, without departing from this disclosure. As more specific examples, the shaft 12 may be engaged with the club head 16 via adhesives, cements, welding, soldering, mechanical connectors (such as threads, retaining elements, or the like), etc. If desired, the shaft 12 may be connected to the club head 16 in a releasable manner using mechanical connectors to allow easy interchange of one shaft 12 for another on the club head 16.

Figure 2A:
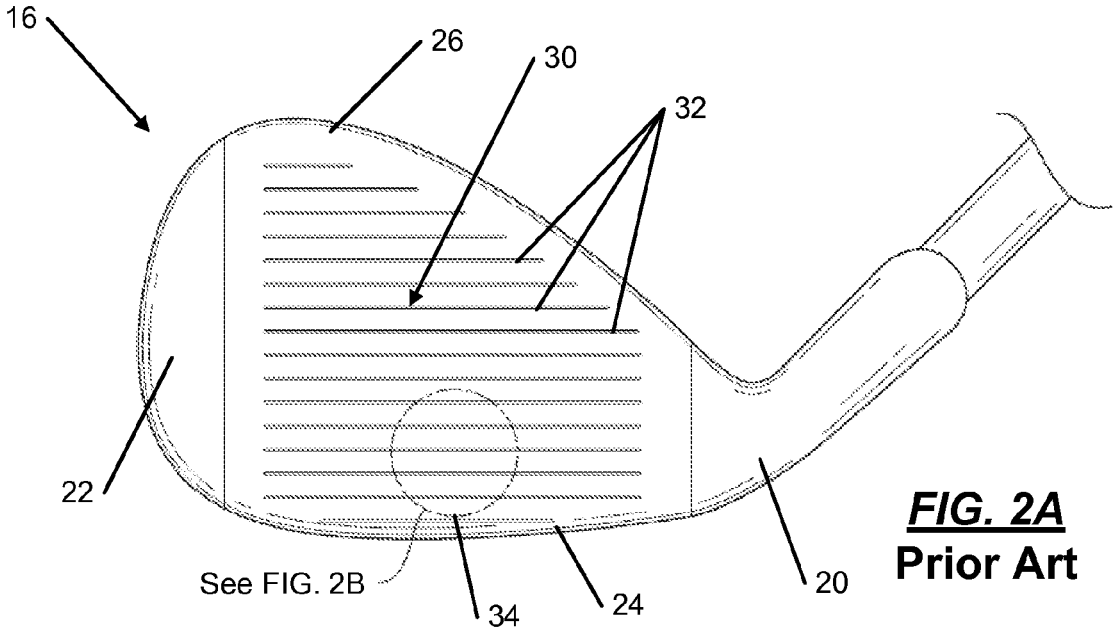
FIG. 2A Prior Art
FIG. 2A illustrates a front view of a prior art golf club head.

A golf club head 16 consistent with the prior art is illustrated in FIG. 2A. The golf club head 16 illustrated in FIG. 2A includes a heel 20, a toe 22, a sole 24, and a top portion 26. The golf club head 16 also includes a striking face 30 that contains a plurality of grooves 32 that extend across at least a portion of the striking face 30. As illustrated in FIG. 2A, the plurality of grooves 32 are generally straight and parallel. The groove pattern 32 is a set of linear lines in which a groove channel/profile is cut into. The groove channel/profile may have a cross-sectional shape such as a square or rectangular shape, a V-shape, or a U-shape, etc.

Figure 2B:
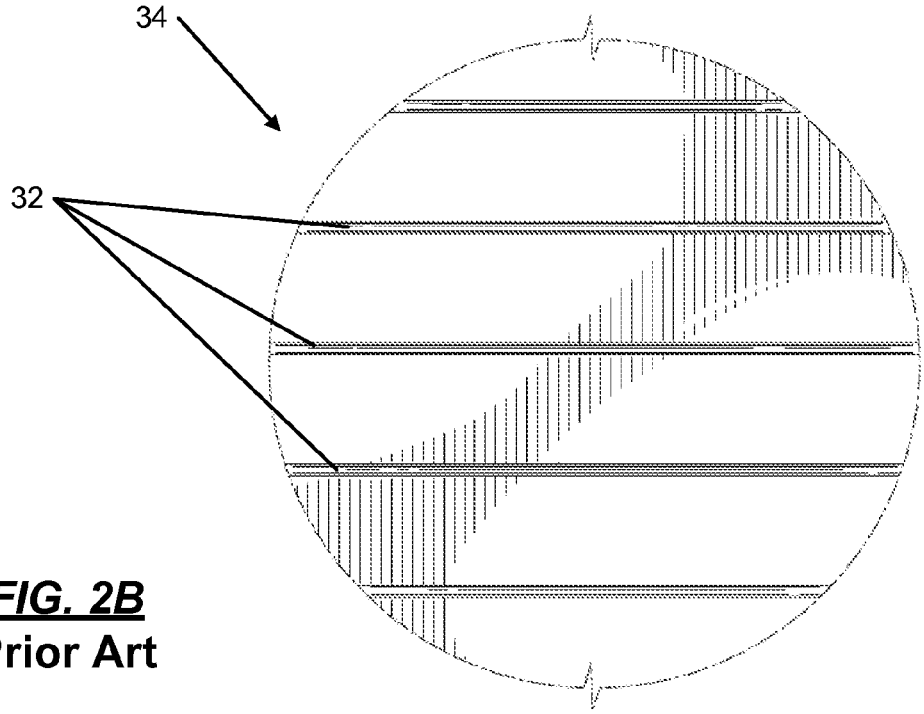
FIG. 2B Prior Art
FIG. 2B illustrates an enlarged view of a circular area representing a compressed ball impact area of the prior art golf club head as illustrated in FIG. 2A.

Additionally, FIG. 2A includes a circle that represents a compressed ball impact area 34. A typical compressed ball impact area 34 has a diameter of approximately 0.75 inches (although the actual impact area for a given impact may vary depending on various factors, such as, impact force, swing speed, club loft, ball hardness, incoming club head impact angle, etc.). A detailed view of this example compressed ball impact area 34 is illustrated in FIG. 2B. Additionally, the compressed ball impact area 34 may be oval or elliptical in shape due to ball sliding on the face and the high loft of the club head and ball being used. For the example compressed ball impact area 34 shown in FIG. 2B, the groove lines 32 within the circle or compressed ball impact area 34 represent the maximum possible groove contact area with a compressed ball when a golf ball is struck with the club head 16. As illustrated in FIG. 2B, this example compressed ball impact area 34 includes approximately five groove lines 32, wherein the total linear groove distance of these five groove lines 32 within the compressed ball impact area 34 is approximately 3.125 inches.

B. Detailed Description of Aspects of this Invention

The remaining figures in this application illustrate examples of golf clubs 10 and golf club heads 16 according to this invention. When the same reference number appears in more than one drawing, that reference number is used consistently in this specification and the drawings to refer to the same or similar parts throughout.

1. Iron-Type Golf Club Heads According to Examples of this Invention

Figure 3A:
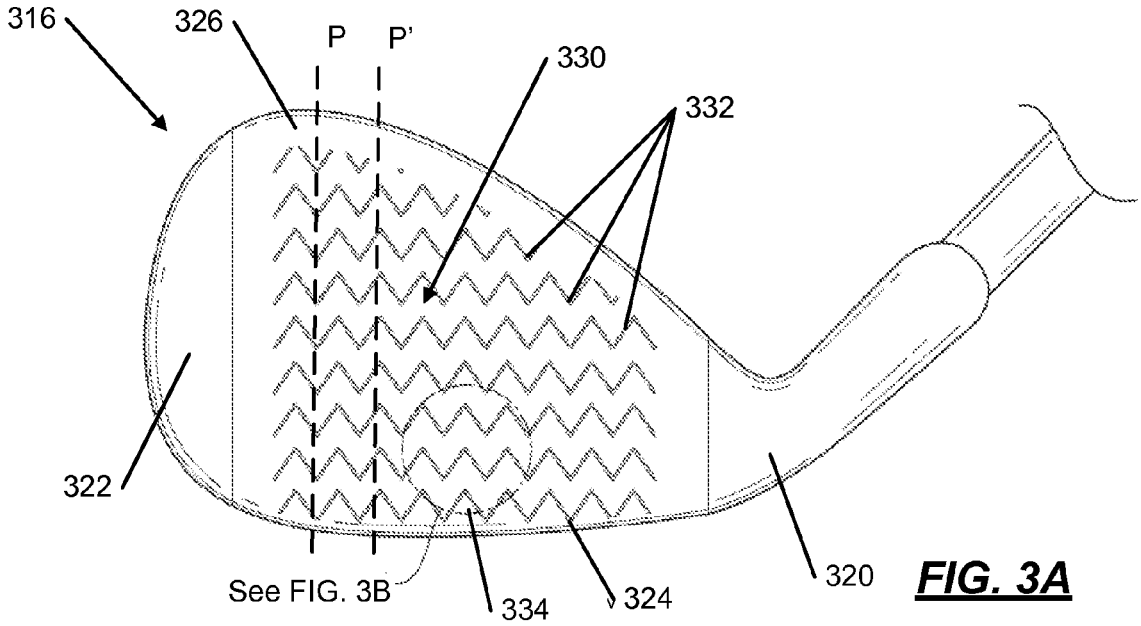
FIG. 3A illustrates a front view of an example golf club head in accordance with the present invention.

As illustrated in FIG. 3A, the golf club head 316 includes a heel 320, a toe 322, a sole 324, and a top portion 326. The golf club head 316 also includes a striking face 330 defined by the heel 320 and the toe 322, and the sole 324 and the top portion 326. The striking face 330 can be an integral part of the golf club head, or the striking face 330 can be a separate piece from, or an insert for, a main body member of the club head 316. The striking face 330 includes a plurality of grooves 332 that extend across at least a portion of the striking face 330. The grooves 332 may also be referred to as channels. The grooves 332 may extend across the striking face 330 from the toe 322 of the club head 316 to the heel 320 of the club head 316.

A wide variety of club head 316 constructions are possible without departing from this disclosure. For example, if desired, some or all of the various individual parts of the club head 316 described above may be made from multiple pieces that are connected together (e.g., by adhesives or cements; by welding, soldering, brazing, or other fusing techniques; by mechanical connectors; etc.). The various parts (e.g., the sole 324, the top portion 326, the striking face 330, etc.) may be made from any desired materials and combinations of different materials, including materials that are conventionally known and used in the art, such as metal materials, including lightweight metal materials, composite materials, polymer materials, steel, titanium, aluminum, tungsten, magnesium, beryllium, alloys including one or more of these metals, carbon-fiber reinforced materials, glass-fiber reinforced materials, graphite, etc.

Additionally, the club head 316 may be constructed in any suitable or desired manner without departing from this disclosure, including in conventional manners known and used in the art. The club head 316 and its various parts may be made by forging, casting, molding, stamping, pressing, machining, grinding, and/or using other techniques and processes, including techniques and processes that are conventional and known in the art.

The dimensions and/or other characteristics of a golf club head 316 according to examples of this disclosure may vary significantly without departing from the disclosure. For example, any iron-type club head may be provided including for example, iron-type hybrid clubs, driving irons, 1 through 9 irons, wedges (e.g., pitching wedges, lob wedges, gap wedges, sand wedges, etc.), and chipping clubs. Additionally, for example, any wood-type club head may be provided without departing from this invention.

As illustrated in FIG. 3A, the plurality of grooves 332 are generally in a herringbone pattern and parallel. The term "parallel," as used in this specification in this context, unless otherwise noted, means that the grooves 332 in different lines on the ball striking face 330 align in the club head top-to-bottom direction (when the club is held at its intended lie angle) such that the bottoms of the Vs align on a common vertical plane P and such that the apexes connecting adjacent Vs also align on a common vertical plane P'. The herringbone groove pattern 332 generally includes two or more rows of short diagonal, parallel grooves slanting in alternate directions to form a series of parallel Vs or zigzags. While any number of parallel groove rows may be provided in a given club head structure, in general, golf club heads will have between 3 and 20 rows of grooves, and in some club heads, between 5 and 16 rows.

Figure 3B:
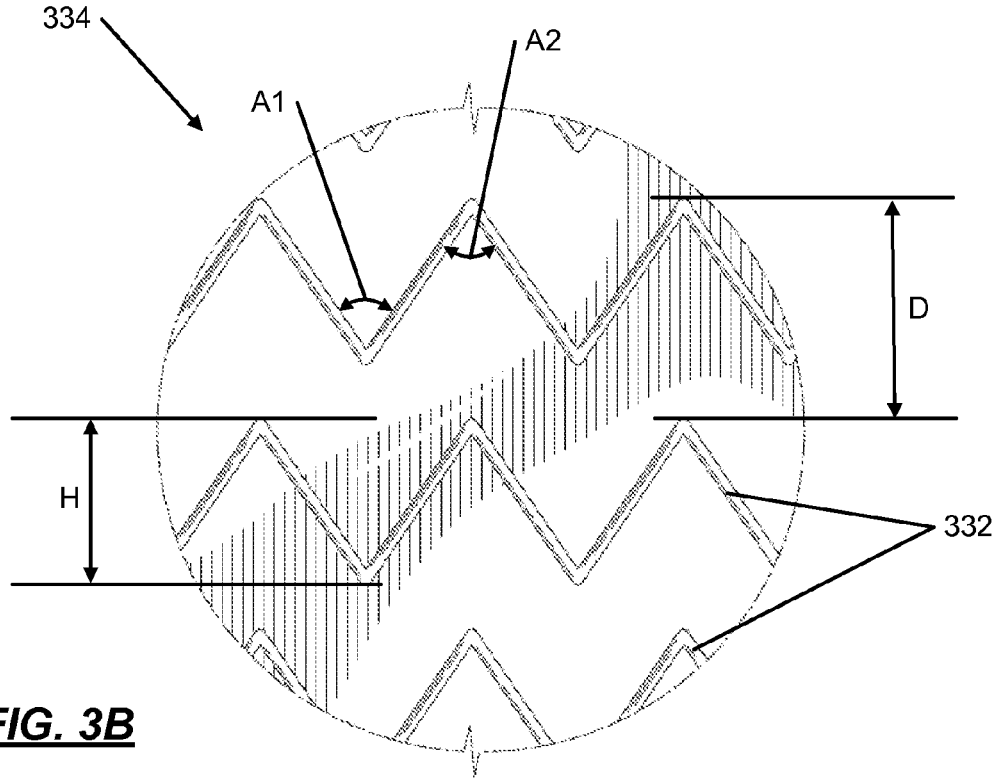
FIG. 3B illustrates an enlarged view of a circular area representing a compressed ball impact area of the golf club head as illustrated in FIG. 3A in accordance with the present invention.

The herringbone groove pattern 332 may include a height H of each groove, as identified in FIG. 3B. The height H may be defined from the top of the V in the herringbone groove to the bottom of the V in the herringbone groove. The height H as illustrated in FIG. 3B may be approximately 0.2 inches. In other examples of this invention, the height H may be between approximately 0.1 inches and approximately 0.5 inches. In other examples of this invention, the height may be between approximately 0.15 inches and approximately 0.25 inches. In yet other examples of this invention, the height H may be between approximately 0.1 inches and approximately 0.75 inches.

The herringbone groove pattern 332 may also include a distance D between each herringbone groove 332, as illustrated in FIG. 3B. The distance D of the herringbone groove pattern 332 as illustrated in FIG. 3B may be approximately 0.25 inches. In other examples of this invention, the distance D may be between approximately 0.075 inches and approximately 0.5 inches. In other examples of this invention, the distance D may be between approximately 0.1 inches and approximately 0.3 inches or even between approximately 0.2 inches and approximately 0.3 inches. In yet other examples of this invention, the distance D may be between approximately 0.075 inches and approximately 0.9 inches.

Additionally, the herringbone groove pattern 332 may include angles A1, A2 between each of the short diagonal legs of the grooves, as illustrated in FIG. 3B. The angles A1, A2 of the herringbone groove pattern 332 as illustrated in FIG. 3B may be approximately 60 degrees. In other examples of this invention, the angles A1, A2 may be between approximately 30 and 140 degrees. In other examples of this invention, the angles A1, A2 may be between approximately 10 and 170 degrees. In yet other examples of this invention, the angles A1, A2 may be between approximately 60 and 100 degrees.

The groove channel/profile may have any desired cross-sectional shape, such as a square or rectangular shape, a V-shape, or a U-shape, etc., without departing from this invention. Additional groove channel/profile shapes may be utilized as are known and used in the art without departing from this invention.

Additionally, FIG. 3A includes a circle that represents a compressed ball impact area 334. Like that shown in FIGS. 2A and 2B, this example compressed ball impact area 334 has a diameter of approximately 0.75 inches. An enlarged view of the compressed ball impact area 334 is illustrated in FIG. 3B. The groove lines 332 within the circle or compressed ball impact area 334 represent the groove contact with a compressed ball when the golf ball is struck with the club head 316 in this example. As illustrated in FIG. 3B, the compressed ball impact area 334 includes a total linear groove distance of the groove lines within the compressed ball impact area 334 of approximately 3.446 inches. This total linear groove distance represents over a 10% increase over the prior art club head and groove configuration as illustrated in FIGS. 2A and 2B for the same compressed ball area size.

Additionally, in other embodiments in accordance with this invention and similar to the herringbone groove configuration 334 as illustrated in FIGS. 3A and 3B, features of the herringbone groove configuration 334 may be different without departing from this invention.

One feature that may be different without departing from this invention is the number of herringbone shaped grooves 334 on the striking face 330. The striking face 330 illustrated in FIG. 3A shows approximately nine separate herringbone shaped grooves 332 on the striking face 330, all equally spaced from one another. For example, in another configuration in accordance with this invention, the striking face 330 may have more than nine separate herringbone shaped grooves 332, such as ten, eleven, or even as many as fifteen or twenty separate herringbone shaped grooves 332 on the striking face 330. Typically, as the number of herringbone grooves 332 is increased on the striking face 330, the distance D between the grooves may be decreased (and vice versa). It should also be understood that as the number of grooves 332 is increased, the total linear groove distance within the compressed ball impact area 334 will generally increase also (and vice versa). Also, in another example configuration in accordance with this invention, the striking face 330 may have less than nine separate herringbone shaped grooves 332, such as eight, seven or as little as five separate herringbone shaped grooves 332 on the striking face 330.

Another feature that may be different without departing from this invention is the angle of the herringbone grooves 332, as represented by angles A1, A2, in FIG. 3B. The striking face 330 illustrated in FIG. 3B shows a herringbone groove configuration 332 wherein the angles A1, A2 are approximately 60 degrees. In other configurations in accordance with this invention, the angles A1, A2 may be less than 60 degrees. It should be understood that as the angles A1, A2 get closer to 0 degrees, the total linear groove distance within the compressed ball impact area 334 will generally increase. In still other configurations according to this invention, the angles A1, A2 may be greater than 60 degrees and even obtuse angles. It should also be understood that as the angles A1, A2 get closer to 180 degrees, the total linear groove distance within the compressed ball impact area 334 will generally decrease.

Additionally, the striking face 330 illustrated in FIG. 3B shows a herringbone groove configuration 332 wherein the angles A1 and A2 are approximately equal angles. In another configuration according to this invention, the angles A1 and A2 may not be equal angles. For example, angle A1 may be a right angle and angle A2 may be an acute angle (e.g., about 60 degrees). In another example, angle A1 may be an obtuse angle and angle A2 may be a right angle. Any combination of angles may be utilized for the herringbone grooves 332 without departing from this invention.

Another feature that may be different without departing from this invention is the height of the herringbone grooves 332, as represented by H, in FIG. 3B. The striking face 330 illustrated in FIG. 3B shows a herringbone groove configuration 332 wherein the height H is approximately 0.2 inches. In another configuration in accordance with this invention, the height H of the herringbone groove 332 may be more than 0.2 inches. It should be understood that as the height H of the herringbone groove 332 is increased, the total linear groove distance within the compressed ball impact area 334 will generally increase. In another configuration in accordance with this invention, the height H of the herringbone groove 332 may be less than 0.2 inches. It should be understood that as the height H of the herringbone groove 332 is decreased, the total linear groove distance within the compressed ball impact area 334 will generally decrease.

Figure 4A:
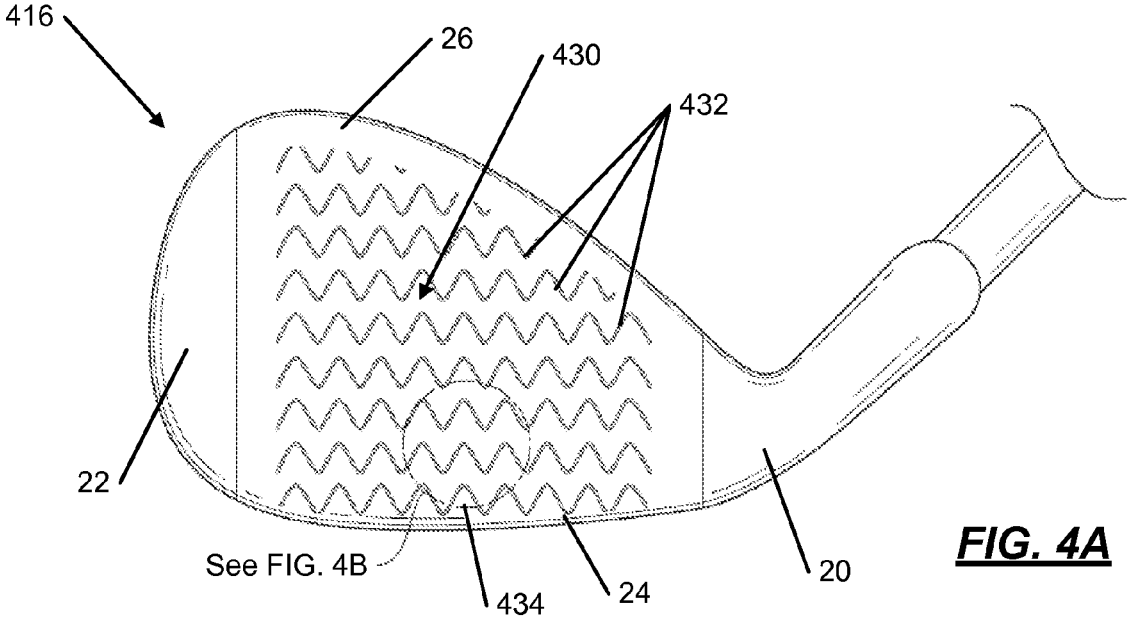
FIG. 4A illustrates a front view of another example golf club head in accordance with the present invention.
Figure 4B:
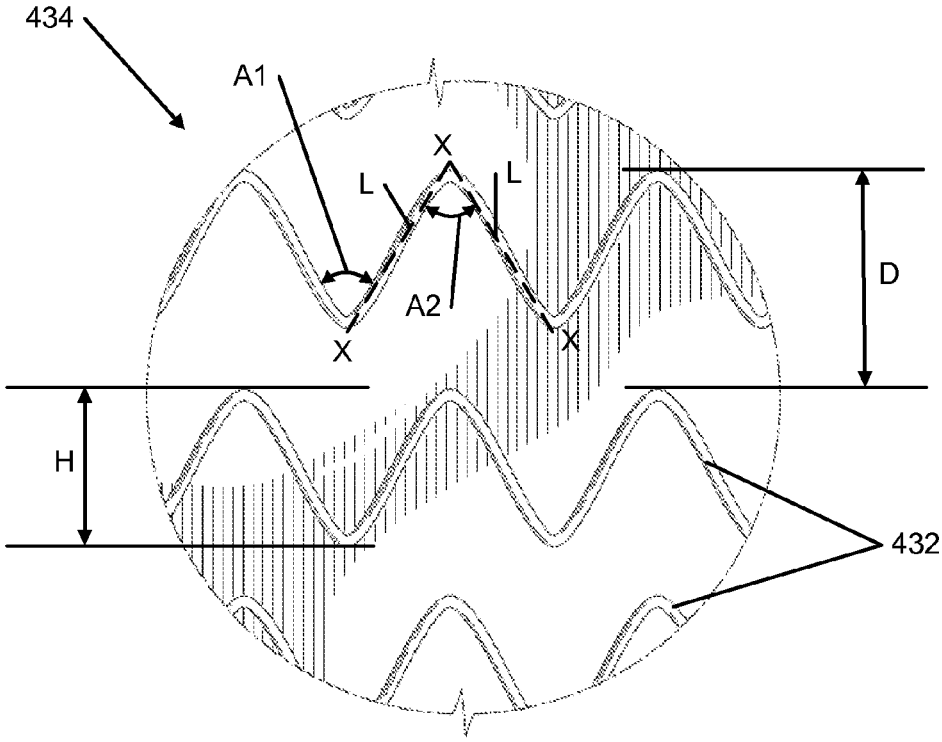
FIG. 4B illustrates an enlarged view of a circular area representing a compressed ball impact area of the golf club head as illustrated in FIG. 4A in accordance with the present invention.

In another example club head 416 in accordance with the invention, as illustrated in FIG. 4A, a plurality of grooves 432 on the striking face 430 are generally in a rounded herringbone pattern and parallel. The rounded herringbone groove pattern 432 is generally similar to the above described herringbone groove configuration, however, the rounded herringbone groove configuration 432 has rounded corners as illustrated in FIGS. 4A and 4B. For example, the rounded herringbone groove pattern 432 includes diagonal grooves that are rounded at the ends, where each diagonal groove meets its corresponding alternate diagonal groove. Additionally, the legs of each "V" in this groove pattern 432 may be straight or curved. The groove channel/profile may have a cross-sectional shape such as a square or rectangular shape, a V-shape, or a U-shape without departing from this invention. Additional groove channel/profile shapes may be utilized as is known and used in the art without departing from this invention.

Additionally, FIG. 4A includes a circle that represents an example compressed ball impact area 434. This example compressed ball impact area 434 again has a diameter of approximately 0.75 inches. An enlarged view of the compressed ball impact area 434 is illustrated in FIG. 4B. The groove lines 432 within the circle or compressed ball impact area 434 represent the groove contact with a compressed ball when the golf ball is struck with the club head 416 in this example impact. As illustrated in FIG. 4B, the compressed ball impact area 434 includes a total linear groove distance of the groove lines 432 within the compressed ball impact area 434 of approximately 3.709 inches. This total linear groove distance represents over an 18% increase over the prior art club head and groove configuration as illustrated in FIGS. 2A and 2B.

Additionally, in other embodiments in accordance with this invention and similar to the rounded groove configuration as illustrated in FIGS. 4A and 4B, features of the herringbone groove configuration 432 may be different without departing from this invention.

One feature that may be different without departing from this invention is the number of herringbone shaped grooves 432 on the striking face 430. The striking face 430 illustrated in FIG. 4A shows approximately nine separate herringbone shaped grooves 432 on the striking face 430, all equally spaced from one another. For example, in another configuration in accordance with this invention, the striking face 430 may have more than nine separate herringbone shaped grooves 432, such as ten, eleven, or even as many as fifteen or twenty separate herringbone shaped grooves 432 on the striking face 430. Typically, as the number of herringbone grooves 432 is increased on the striking face 430, the distance D between the grooves 432 may be decreased (and vice versa). It should also be understood that as the number of grooves 432 is increased, the total linear groove distance within the compressed ball impact area 434 will generally increase also (and vice versa). Also, in another example configuration in accordance with this invention, the striking face 430 may have less than nine separate herringbone shaped grooves 432, such as eight, seven or as little as five separate herringbone shaped grooves 432 on the striking face 430.

Another feature that may be different without departing from this invention is the angle of the herringbone grooves 432, as represented by angles A1, A2 in FIG. 4B. The striking face 430 illustrated in FIG. 4B shows a herringbone groove configuration 432 wherein the angles A1, A2 are approximately 60 degrees (in structures where the corners and/or legs of the V's are rounded, the angles A1, A2 may be measured using straight lines L connecting the apexes X of the grooves, as shown in FIG. 4B). In other configurations in accordance with this invention, the angles A1, A2 may be less than 60 degrees. It should be understood that as the angles A1, A2 get closer to 0 degrees, the total linear groove distance within the compressed ball impact area 434 will generally increase. In still other configurations according to this invention, the angles A1, A2 may be greater than 60 degrees or even obtuse angles. It should also be understood that as the angles A1, A2 get closer to 180 degrees, the total linear groove distance within the compressed ball impact area 434 will generally decrease.

Additionally, the striking face illustrated in FIG. 4B shows a herringbone groove configuration 434 wherein the angles A1 and A2 are approximately equal angles. In another configuration according to this invention, the angles A1 and A2 may not be equal angles. For example, angle A1 may be a right angle and angle A2 may be an acute angle (e.g., about 60 degrees). In another example, angle A1 may be an obtuse angle and angle A2 may be a right angle. Any combination of angles may be utilized for the herringbone grooves 432 without departing from this invention.

Another feature that may be different without departing from this invention is the height of the herringbone grooves 432, as represented by H, in FIG. 4B. The striking face 430 illustrated in FIG. 4B shows a herringbone groove configuration 432 wherein the height H is approximately 0.2 inches. In another configuration in accordance with this invention, the height H of the herringbone groove 432 may be more than 0.2 inches. It should be understood that as the height H of the herringbone groove 432 is increased, the total linear groove distance within the compressed ball impact area 434 will generally increase. In another configuration in accordance with this invention, the height H of the herringbone groove 432 may be less than 0.2 inches. It should be understood that as the height H of the herringbone groove 432 is decreased, the total linear groove distance within the compressed ball impact area 434 will generally decrease.

Figure 5A:
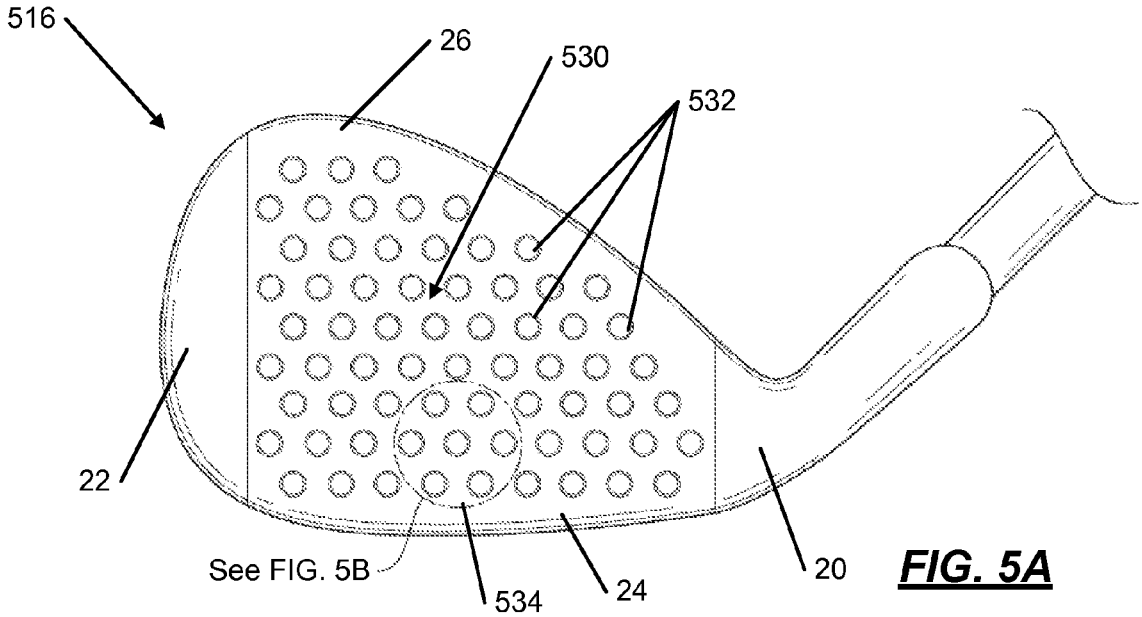
FIG. 5A illustrates a front view of another example golf club head in accordance with the present invention.

Additionally, in other examples in accordance with this invention, the club head may have a striking face that includes other shapes for the groove pattern. For example, FIG. 5A illustrates a club head 516 and a striking face 530 that includes a plurality of grooves 532 defined by circles. Other shapes may be used for the plurality of grooves 532 without departing from the invention, such as squares, rectangles, triangles, other polygons (e.g., polygons having from 5 to 30 sides), ellipses, ovals, stars, block alpha-numeric characters, irregular shapes, etc. As described above, the groove channel/profile may have a cross-sectional shape such as a square or rectangular shape, a V-shape, or a U-shape without departing from this invention. Additional groove channel/profile shapes may be utilized as are known and used in the art without departing from this invention.

Figure 5B:
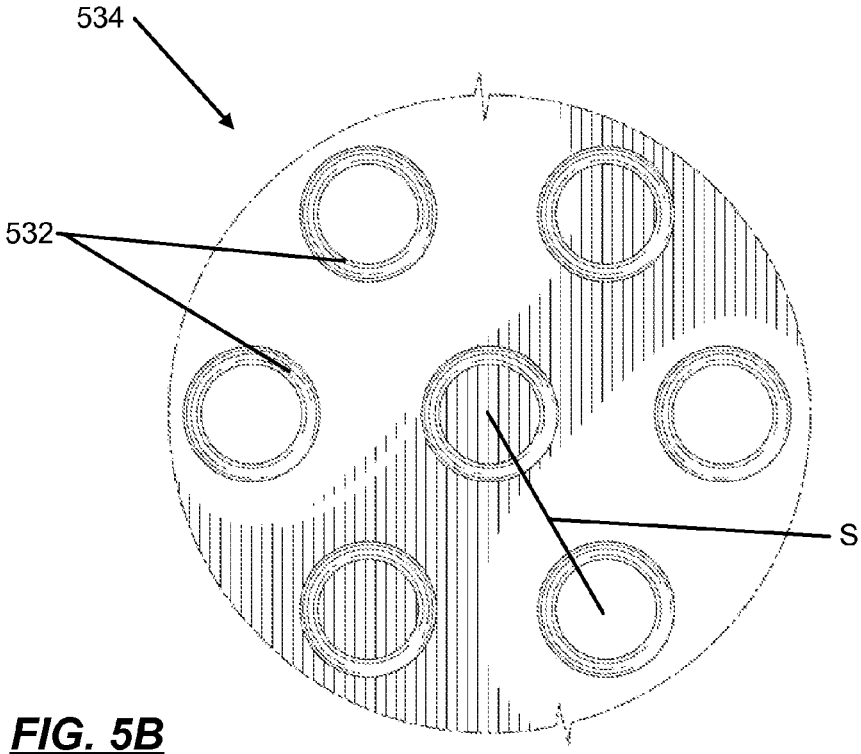
FIG. 5B illustrates an enlarged view of a circular area representing a compressed ball impact area of the golf club head as illustrated in FIG. 5A in accordance with the present invention.

Additionally, FIG. 5A includes a circle that represents a compressed ball impact area 534. The compressed ball impact area 534 has a diameter of approximately 0.75 inches. An enlarged view of the compressed ball impact area 534 is illustrated in FIG. 5B. The groove lines 532 within the circle or compressed ball impact area 534 represent the groove contact with a compressed ball when a golf ball is struck with the club head 516 in this example. As illustrated in FIG. 5B, the compressed ball impact area 534 of this example includes approximately eight circular groove lines 532, wherein the total linear groove distance of these groove lines 532 within the compressed ball impact area 534 is approximately 2.969 inches. The circular groove pattern 532 may include more or less circles without departing from this invention. Additionally, the circular groove pattern 532 may include bigger or smaller circles and/or the circles may be located closer together (center-to-center distance S) or farther apart without departing from this invention. The striking face 530 illustrated in FIG. 5B shows a circular groove configuration 532 wherein the center-to-center distance S is approximately 0.3 inches. In another configuration in accordance with this invention, the center-to-center distance S of the circular groove 532 may be more than 0.3 inches. It should be understood that as the center-to-center distances S of the circular groove 532 is increased, the total linear groove distance within the compressed ball impact area 534 will generally increase. In another configuration in accordance with this invention, the center-to-center distance S of the circular groove 532 may be less than 0.3 inches.

Further, a single groove pattern 532 may include circles of different sizes, combinations of different shapes, and/or one or more shapes arranged in different patterns (from that shown in FIGS. 5A and 5B) across the striking face 530 without departing from this invention. Additionally, if desired, the center-to-center spacings S between adjacent circles and/or other shapes may be varied without departing from this invention.

C. Detailed Description of Additional Aspects of this Invention

Method of Producing the Golf Club

Additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head 16 of the various types described above (including any or all of the various structures, features, and/or arrangements described above), e.g., by manufacturing or otherwise constructing the golf club head 16, such as by joining some or all of the various individual parts of the club head (when the club head is made from multiple pieces that are connected together (e.g., by adhesives or cements; by welding, soldering, or brazing, or other fusing techniques; by mechanical connectors, etc.)) or by obtaining the golf club head 16 from a third party source, etc.; (b) engaging a shaft 12 with the golf club head 16 in any suitable or desired manner, including conventional manners known and used in the art, e.g., via adhesives, cements, welding, soldering, mechanical connectors (such as threads, retaining elements, or the like, and optionally in a releasable manner to allow easy interchange of one shaft 12 for another on the club head 16); and (c) engaging a grip 14 with the shaft member 12, such as by attaching to, engaging with, or extending from the shaft member 12 in any suitable or desired manner, including conventional manners known and used in the art, e.g., using adhesives or cements, via welding, soldering, brazing, or the like, via mechanical connectors (such as threads, retaining elements, etc., including through releasable connection structure), etc.

The various parts (e.g., sole 24, top portion 26, striking face 30, etc.) may be made from any desired materials and combinations of different materials, including materials that are conventionally known and used in the art, such as metal materials, including lightweight metal materials, composite materials, polymer materials, steel, titanium, aluminum, tungsten, magnesium, beryllium, alloys including one or more of these metals, carbon-fiber reinforced materials, glass-fiber reinforced materials, graphite, etc.

Additionally, the club head 16 and striking face 30 may be constructed in any suitable or desired manner and/or from any suitable or desired materials without departing from this disclosure, including from conventional materials and/or in conventional manners known and used in the art. The club head 16 and striking face 30 may be made by forging, casting, molding, and/or using other techniques and processes, including techniques and processes that are conventional and known in the art.

The grooves may be formed in the ball striking face of the club head in any desired manner without departing from this invention, including, for example, by forming the ball striking face with the grooves therein (e.g., by casting, etc.), by cutting the grooves into the material of the ball striking face, etc. If desired, the grooves may be formed in the ball striking face in manners that are conventionally known and used in the art.

The advantages and benefits of golf club heads with a club face and a groove configuration in accordance with this invention may be readily apparent to those of skill in the art. For example, as described above, the groove configurations as illustrated in FIGS. 3A through 4B have an increased groove contact with a compressed golf ball when the golf ball is struck with the club head over the prior art groove configurations. For example, the groove configuration as illustrated in FIGS. 3A and 3B has a total linear groove distance within the compressed ball impact area that is over 10% more than the prior art groove configurations. Also, the groove configuration as illustrated in FIGS. 4A and 4B has a total linear groove distance within the compressed ball impact area that is over 18% more than the prior art groove configurations.

In addition to the increased groove contact distance, golf club heads with a club face and the herringbone groove configuration may have a radial pinch on the grooves of the club face. With the herringbone groove pattern, as illustrated in FIGS. 3A through 4B, there is a radial pinch on the groove by an ever changing groove-contact-to-ball vector. On the prior art linear groove configurations, the golf ball can slip off the groove contact because there is no radial pinch. However, with the herringbone groove pattern, there is equal groove pinch on each side of the groove to the ball as well as the top of the groove. For example, on higher loft clubs, the ball may slide up the face rapidly when the ball is struck with the club. However, both surface friction and a radial pinch on the ball are both factors that may minimize this upward ball slide. The herringbone groove configuration in accordance with this invention has grooves that pinch the ball at a right angle will help to resist this upward ball slide during ball contact.

D. Conclusion

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

We claim:

1. A golf club head, comprising:

a ball striking face comprising a plurality of spaced, parallel grooves that extend across at least a portion of the striking face, wherein the grooves form a herringbone groove pattern that includes two or more rows of diagonal, parallel grooves slanting in alternate directions to form a series of parallel Vs, wherein the herringbone groove pattern includes a height defined from a bottom of a first V to a top of the first V, wherein the height is between approximately 0.1 inch inches and approximately 0.4 inch.

2. The golf club head of claim 1, wherein the height is between approximately 0.15 inch and approximately 0.25 inch.

3. A golf club head, comprising:

a ball striking face comprising a plurality of spaced, parallel grooves that extend across at least a portion of the striking face, wherein the grooves form a herringbone groove pattern, wherein the herringbone groove pattern includes a distance defined between each groove, wherein the distance is between approximately 0.075 inch and approximately 0.5 inch.

4. The golf club head of claim 3, wherein the distance is between approximately 0.2 inch and approximately 0.3 inch.

5. A golf club head, comprising:

a ball striking face comprising a plurality of spaced, parallel grooves that extend across at least a portion of the striking face, wherein the grooves form a herringbone groove pattern that includes two or more rows of diagonal, parallel grooves slanting in alternate directions to form a series of parallel Vs, wherein the herringbone groove pattern includes a first angle located at a bottom of a first V and a second angle connecting adjacent Vs, wherein the first angle and the second angle are equal.

6. The golf club head of claim 5, wherein the first angle and the second angle are within a range of 30-140 degrees.

7. The golf club head of claim 5, wherein the first angle and the second angle are within a range of 60-100 degrees.

8. The golf club head of claim 5, wherein the herringbone groove pattern includes nine separate herringbone shaped grooves.

9. The golf club head of claim 5, wherein the herringbone groove pattern is a rounded herringbone groove pattern, with the diagonal grooves being rounded.

10. A golf club head, comprising:

a ball striking face comprising a plurality of spaced, parallel grooves that extend across at least a portion of the striking face, wherein the grooves form a herringbone groove pattern that includes two or more rows of diagonal, parallel grooves slanting in alternate directions to form a series of parallel Vs, wherein the herringbone groove pattern includes a first angle located at a bottom of a first V and a second angle connecting adjacent Vs, wherein the first angle and the second angle are not equal.

11. An iron-type golf club, comprising:

a shaft;

a grip attached to the shaft; and a golf club head engaged with the shaft, wherein the golf club head further includes a ball striking face comprising a plurality of spaced, parallel grooves that extend across at least a portion of the ball striking face, wherein the grooves form a herringbone groove pattern that includes two or more rows of diagonal, parallel grooves slanting in alternate directions to form a series of parallel Vs, wherein the herringbone groove pattern includes a height defined from a bottom of a first V to a top of the first V, wherein the height is between approximately 0.1 inch and approximately 0.4 inch.

12. The golf club of claim 11, wherein the height is between approximately 0.15 inch and approximately 0.25 inch.

13. An iron-type golf club, comprising:

a shaft;

a grip attached to the shaft; and a golf club head engaged with the shaft, wherein the golf club head further includes a ball striking face comprising a plurality of spaced, parallel grooves that extend across at least a portion of the ball striking face, wherein the grooves form a herringbone groove pattern that includes two or more rows of diagonal, parallel grooves slanting in alternate directions to form a series of parallel Vs, wherein the herringbone groove pattern includes a distance defined between each groove, wherein the distance is between approximately 0.075 inch and approximately 0.5 inch.

14. The golf club of claim 13, wherein the distance is between approximately 0.2 inch and approximately 0.3 inch.

15. An iron-type golf club, comprising:

a shaft;

a grip attached to the shaft; and a golf club head engaged with the shaft, wherein the golf club head further includes a ball striking face comprising a plurality of spaced, parallel grooves that extend across at least a portion of the ball striking face, wherein the grooves form a herringbone groove pattern that includes two or more rows of diagonal, parallel grooves slanting in alternate directions to form a series of parallel Vs, wherein the herringbone groove pattern includes a first angle located at a bottom of a first V and a second angle connecting adjacent Vs, wherein the first angle and the second angle are equal.

16. The golf club of claim 15, wherein the first angle and the second angle are within a range of 30-140 degrees.

17. The golf club of claim 16, wherein the first angle and the second angle are within a range of 60-100 degrees.

18. The golf club of claim 15, wherein the herringbone groove pattern includes at least nine separate herringbone shaped grooves.

19. The golf club of claim 15, wherein the herringbone groove pattern is a rounded herringbone groove pattern, with the diagonal grooves being rounded.

20. An iron-type golf club, comprising:

a shaft;

a grip attached to the shaft; and a golf club head engaged with the shaft, wherein the golf club head further includes a ball striking face comprising a plurality of spaced, parallel grooves that extend across at least a portion of the ball striking face, wherein the grooves form a herringbone groove pattern that includes two or more rows of diagonal, parallel grooves slanting in alternate directions to form a series of parallel Vs, wherein the herringbone groove pattern includes a first angle located at a bottom of a first V and a second angle connecting adjacent Vs, wherein the first angle and the second angle are not equal.

21. A golf club head, comprising:

a ball striking face comprising a plurality of spaced, parallel grooves that extend across at least a portion of the ball striking face, wherein the grooves form a herringbone groove pattern that includes two or more rows of diagonal, parallel grooves slanting in alternate directions to form a series of parallel Vs, wherein the herringbone groove pattern includes a height defined from a bottom of a first V to a top of the first V that is between approximately 0.15 inch and approximately 0.25 inch, wherein the herringbone groove pattern includes a distance defined between each groove that is between approximately 0.2 inch and approximately 0.3 inch, and further wherein the herringbone groove pattern includes a first angle located at the bottom of the first V and a second angle connecting adjacent Vs, wherein each of the first angle and the second angle is within a range of 30-140 degrees.

22. The golf club head of claim 21, wherein the herringbone groove pattern is a rounded herringbone groove pattern, with the diagonal grooves being rounded.

23. An iron-type golf club, comprising:

a shaft;

a grip attached to the shaft; and a golf club head engaged with the shaft, wherein the golf club head further includes a ball striking face comprising a plurality of spaced, parallel grooves that extend across at least a portion of the ball striking face, wherein the grooves form a herringbone groove pattern that includes two or more rows of diagonal, parallel grooves slanting in alternate directions to form a series of parallel Vs, wherein the herringbone groove pattern includes a height defined from a bottom of a first V to a top of the first V that is between approximately 0.15 inch and approximately 0.25 inch, wherein the herringbone groove pattern includes a distance defined between each groove that is between approximately 0.2 inch and approximately 0.3 inch, and further wherein the herringbone groove pattern includes a first angle located at the bottom of the first V and a second angle connecting adjacent Vs, wherein each of the first angle and the second angle is within a range of 30-140 degrees.

24. The golf club of claim 23, wherein the herringbone groove pattern is a rounded herringbone groove pattern, with the diagonal grooves being rounded.

* * * * *